US006050565A

United States Patent [19]

Fetherolf

[11] Patent Number: 6,050,565

[45] Date of Patent: Apr. 18, 2000

[54] OVERFILL CONTROL APPARATUS FOR A MEDIA INPUT TRAY

[75] Inventor: Will G. Fetherolf, Boise, Id.

[73] Assignee: Hewlett-Packard Company, Palo Alto, Calif.

[21] Appl. No.: 08/814,072

[22] Filed: Mar. 10, 1997

[51] Int. Cl.[7] ..... B65H 1/00; B65H 1/26; B65H 1/22

[52] U.S. Cl. ..... 271/145; 271/157; 271/162; 271/164

[58] Field of Search ..... 271/145, 157, 271/162, 164

[56] References Cited

U.S. PATENT DOCUMENTS

| | | | |
|---|---|---|---|
| 3,720,408 | 3/1973 | Horn | 271/145 |
| 4,415,263 | 11/1983 | Hoffman | 271/145 |
| 5,150,891 | 9/1992 | Svyatsky et al. | 271/157 |
| 5,205,550 | 4/1993 | Perino | 271/157 |
| 5,222,722 | 6/1993 | Kamano | 271/145 |

FOREIGN PATENT DOCUMENTS

| | | |
|---|---|---|
| 0418740 | 3/1991 | European Pat. Off. . |
| 0700851 | 3/1996 | European Pat. Off. . |
| 2726221 | 5/1996 | France . |
| 06191655 | 7/1994 | Japan . |
| 06247568 | 9/1994 | Japan . |
| 63001640 | 1/1998 | Japan . |

OTHER PUBLICATIONS

European Search Report.

*Primary Examiner*—Donald P. Walsh
*Assistant Examiner*—Daniel K Schlak
*Attorney, Agent, or Firm*—Lane R. Simmons

[57] ABSTRACT

An input tray mechanism for feeding sheet media to a page printer includes a structural configuration for preventing overfilling of sheet media therein. A support structure includes a receiving area, an enlarged opening thereto, and a shelf formed at a base of the enlarged opening for inhibiting passage of excess media beyond the shelf and further into the support structure. The shelf prevents overfill of the input tray mechanism by abruptly stopping excess media from passing further into the input tray mechanism. In a preferred embodiment, the support structure is formed as part of a side adjuster for the input tray, and the support structure is vertically oriented for receiving sheet media in an upright, on-end position.

27 Claims, 5 Drawing Sheets

OVERFILL CONTROL APPARATUS FOR A MEDIA INPUT TRAY

FIELD OF THE INVENTION

This invention relates in general to media handling systems and, more particularly, to apparatus for receiving and holding sheet paper in image processing systems such as laser printers.

BACKGROUND OF THE INVENTION

In conventional page printers and copiers, sheets of paper or other sheet media are pulled from a stack and fed downstream into the print engine components where the desired image is formed on each sheet. The sheets of paper are typically stacked in a cassette, tray or similar type of paper holder. For ease of discussion purposes, the term "paper tray" or "tray" will be used herein in reference to all types of cassettes, trays, or other holders, regardless of orientation (i.e., horizontally or vertically disposed) and regardless of size or other variations. Paper trays may hold different types, sizes or color of paper or other flat media. Each tray may be a cassette assembly that includes paper feed components, such as a feed roller, shaft and gears, or the tray may simply be fitted in a housing for interconnection with a host image processing device. Most paper trays hold the sheet media stacked in a flat, horizontal orientation. Other trays are vertical in orientation, holding the media in an upright, on-end position, and may use side adjusters for guiding the paper into the holder and adaptively retaining the paper therein.

Certain paper trays employ angled, rounded or curved edges to help guide and slide the paper into its resting position within the tray as the paper is manually loaded therein by a user. Curved edges are notably used in vertically oriented paper trays. In vertical trays, the paper is inserted in a generally upright, on-end position into a mouth opening of the tray. The paper is dropped or pushed further into the tray until it reaches its resting or fully loaded position within the tray. An angled or curved edge may be implemented on the tray at the opening to widen the opening and to assist in guiding the paper into the tray. Optionally, as mentioned, side adjusters are configured on each side of the tray to help align the paper within the tray.

One problem associated with enlarged tray openings is that it is difficult for a user to know how much paper will actually fit in the tray because the opening is wider than the internal dimension of the tray. Thus, a user may attempt to load more paper into the tray than it is capable of physically handling. In such instances, the paper may become wedged too tightly within the tray and thereby cause a paper jam when the paper is automatically picked from the tray by the paper handling system for processing through the imaging device.

Accordingly, an object of the present invention is to inhibit overfilling of a paper tray that employs an enlarged mouth opening to thereby reduce paper jams.

SUMMARY OF THE INVENTION

According to principles of the present invention in a preferred embodiment, an input tray mechanism for feeding sheet media to a page printer includes an apparatus for preventing overfilling of sheet media in the tray. The overfill prevention apparatus reduces paper pick jams in the printer. The input tray mechanism includes a support structure formed so as to receive sheet media therein. The support structure includes an enlarged opening, preferably an angled or curved opening thereto, and also includes a shelf formed at a base of the enlarged opening for inhibiting passage of excess media beyond the shelf and further into the support structure. The preferred angled or curved opening provides an improved loading feature because it is wider than the rest of the support structure and slopes down to a narrower width of the support structure wherein the sheet media is retained prior to entry into the processing path of the page printer. The shelf prevents overfill of the input tray mechanism by abruptly stopping excess media from passing further into the input tray mechanism.

According to further principles in a preferred embodiment, the support structure is formed as part of side adjusters for the input tray, and the support structure is vertically oriented for receiving sheet media in an upright, on-end position.

The support structure forms a first gap for holding a first amount sheet media therein. The shelf forms a second gap capable of holding a second, greater amount of sheet media. As sheets are inserted into the support structure at the enlarged opening, the angle/curvature helps direct the sheets down into the support structure. Any sheets that are in excess over the amount of sheets that the first gap is able to retain are abruptly stopped at the shelf and prohibited from passing into the first gap.

Other objects, advantages, and capabilities of the present invention will become more apparent as the description proceeds.

DETAILED DESCRIPTION OF THE INVENTION

Figure 1:
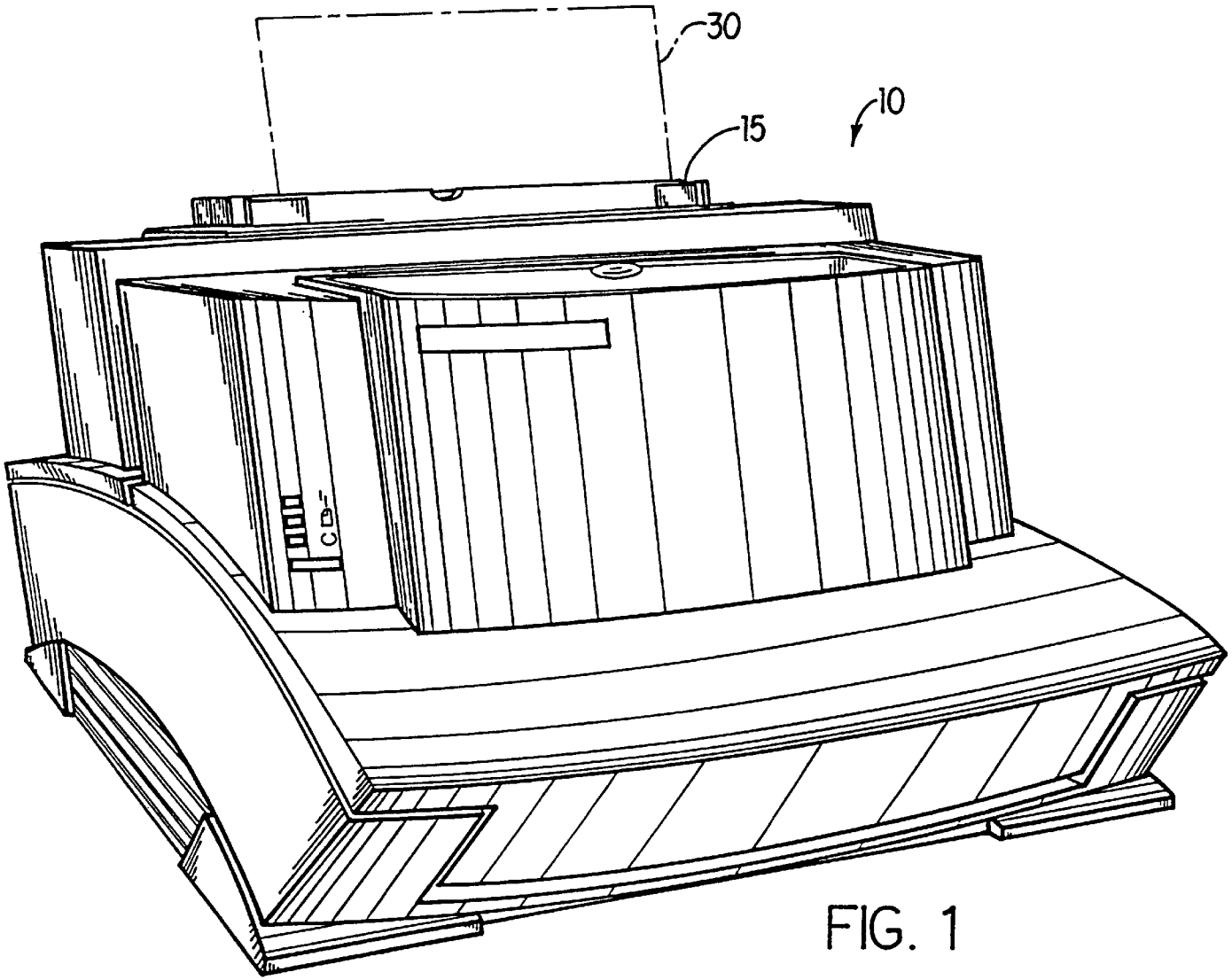
FIG. 1 is a perspective view of a laser printer employing a media input tray having the paper overfill control mechanism of the present invention.

FIG. 1 is a perspective view of laser printer 10 employing media input tray 15 in which the paper overfill control mechanism of the present invention is utilized. Media input tray 15 is configured to hold sheet media, such as paper 30 (shown in dashed phantom), for image processing in printer 10. The paper is picked from tray 15 by a pick mechanism, such as a D-roller, or other means associated with printer 10 for entry into the paper processing path within the printer. Although laser printer 10 is shown and discussed herein, it will be obvious that the present invention is equally applicable for use with other image forming devices, such as inkjet printers, facsimile machines, copy machines, scanners, etc. Moreover, although media input tray 15 is shown as generally vertically oriented for receiving sheet media in an upright, on-end position therein, it will be obvious that the present invention is also equally adaptable to horizontally oriented tray configurations.

Figure 2:
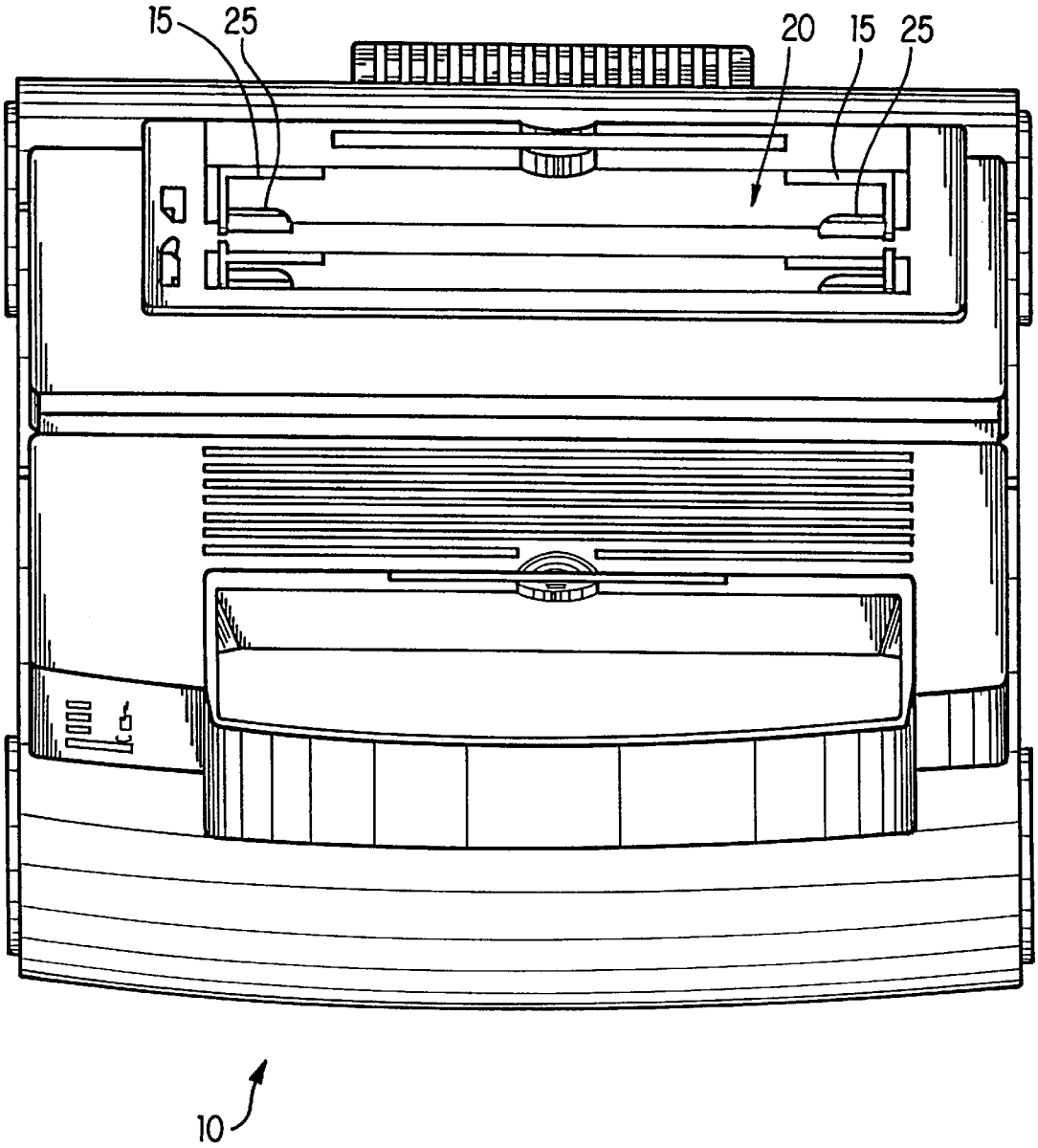
FIG. 2 is a top view of the printer and overfill control mechanism of FIG. 1.

FIG. 2 is a top view of printer 10 showing a top view of the media receiving area of media input tray 15. Tray 15 is disposed within slot 20 of printer 10. Tray 15 includes overfill control mechanism 25 of the present invention.

Figure 3:
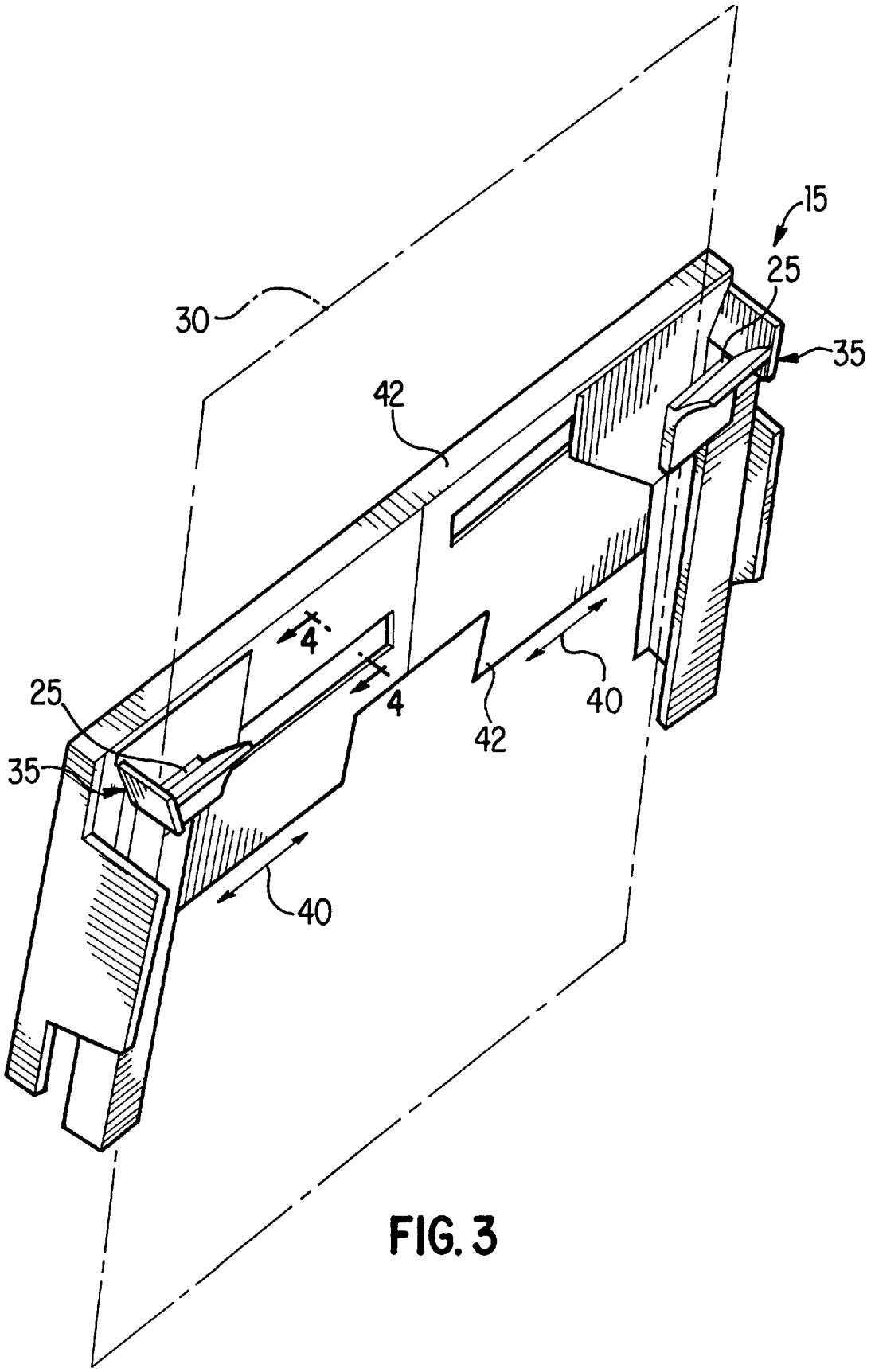
FIG. 3 is a perspective view of a media input tray having the present invention overfill control mechanism.

FIG. 3 is a perspective view of media input tray 15 having overfill control mechanism 25. Here, tray 15 is shown removed from slot 20 (FIG. 2) of printer 10. In general, tray 15 is a support structure formed so as to receive and support sheet media 30 therein. Tray 15 interfits with slot 20 of printer 10 for enabling feeding of sheet media 30 to the internal image processing path of printer 10. In a preferred embodiment, tray 15 is formed in connection with side adjusters for slidably supporting sheet media therein. Specifically, side adjusters 35 are slidably adjustable (as shown by directional arrows 40) with respect to frame 42, for supporting different sized media.

Figure 4:
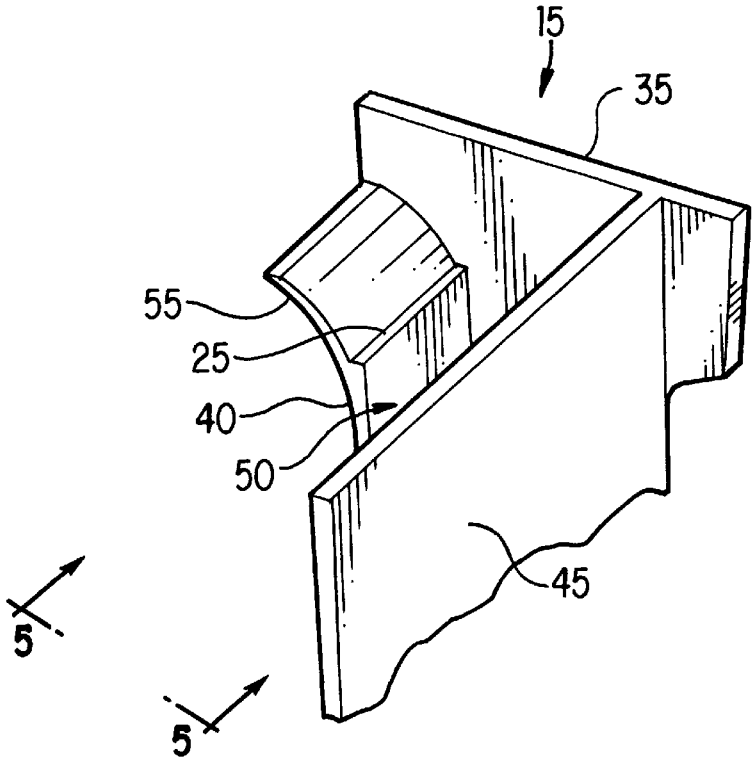
FIG. 4 is a partial perspective view taken along lines 4—4 of FIG. 3.

FIG. 4 is a partial perspective view of the upper opening area of side adjuster 35 as taken along lines 4—4 of FIG. 3. FIG. 4 clearly depicts overfill control mechanism 25 relative to side adjuster 35 of tray 15. Although in a preferred embodiment overfill control mechanism 25 is implemented in connection with side adjusters (as shown), the invention is just as easily applicable in a media tray without side adjusters. As such, the discussion herein will be directed more to implementation of the overfill control mechanism in a "media tray" rather than just a side adjuster. Thus, tray 15 (or side adjuster 35) includes at least first and second support structures (or walls) 40 and 45 disposed so as to form media passage area 50 therebetween. Area 50 is where sheet media 30 is received (see FIG. 3).

Figure 5:
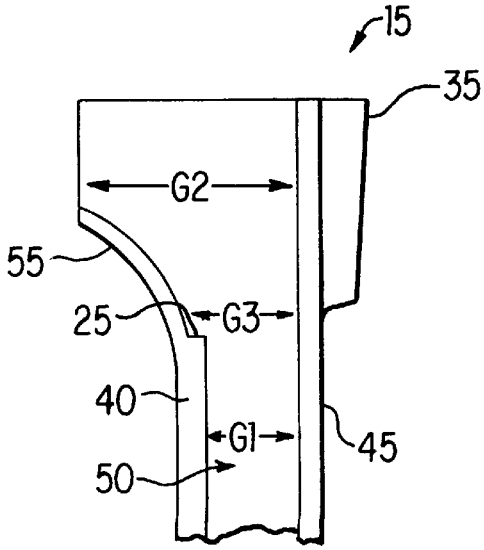
FIG. 5 is an end view taken along lines 5—5 of FIG. 4.

Referring now to FIG. 5, an end view of tray 15 (side adjuster 35) as taken along lines 5—5 of FIG. 4 is depicted. FIG. 5 clearly shows media passage area 50 between walls 40 and 45. Area 50 has a first gap distance G1 between walls 40 and 45 for holding a given amount of sheet media. Although the given amount will vary depending upon the sheet media thickness, it is still a given amount for any particular type of media chosen.

In a preferred embodiment, first wall 40 includes an angled or curved portion 55 which forms a widening gap G2, or enlarged opening area, with respect to gap G1. Only "curved" portion 55 is shown in the Figure, although a generally rectilinear (i.e., box shape) or angled portion (i.e., "V" shape) relative to wall 40 is similarly workable to create the enlarged opening. For example, walls 40 and 45 could be generally parallel in their entirety, with gaps G2 and G3 being generally equal, so long as gaps G2 and G3 are greater than gap G1 to provide for shelf 25.

The enlarged opening area allows a user to more easily insert sheet media into area 50 and helps guide the media therein. At the base of enlarged opening G2 is where overfill control mechanism 25 is formed. In a preferred embodiment, overfill control mechanism 25 is a shelf, or ledge, disposed at an intersecting portion of media passage area 50 and the enlarged opening (i.e., curved surface 55). Shelf 25 forms a gap G3 which is larger than gap G1. Thus, as sheet media is inserted into enlarged opening G2 and directed toward area 50, excess media is abruptly inhibited by shelf 25 from passing into area 50. Specifically, any media in excess of that amount capable of being held in gap G1 is stopped at shelf 25 from entering into media passage area 50. Effectively, therefore, shelf 25 provides an overfill prevention mechanism for media passage area 50. In addition to preventing overfill, shelf 25 provides a means for allowing area 50 to be filled to its maximum capacity without worry for overfill. Overfill is unwanted because it can cause a paper jam when the paper is picked from tray 15 for image processing within printer 10. On the other hand, a tray "full" of sheet media is desirable for efficiency of use purposes. It is undesirable to have to "refill" a paper tray any more often than is necessary. Accordingly, the present invention satisfies both goals in that it prevents overfill and paper jams, and yet allows the tray to be filled to capacity for most efficient usage.

Figure 6:
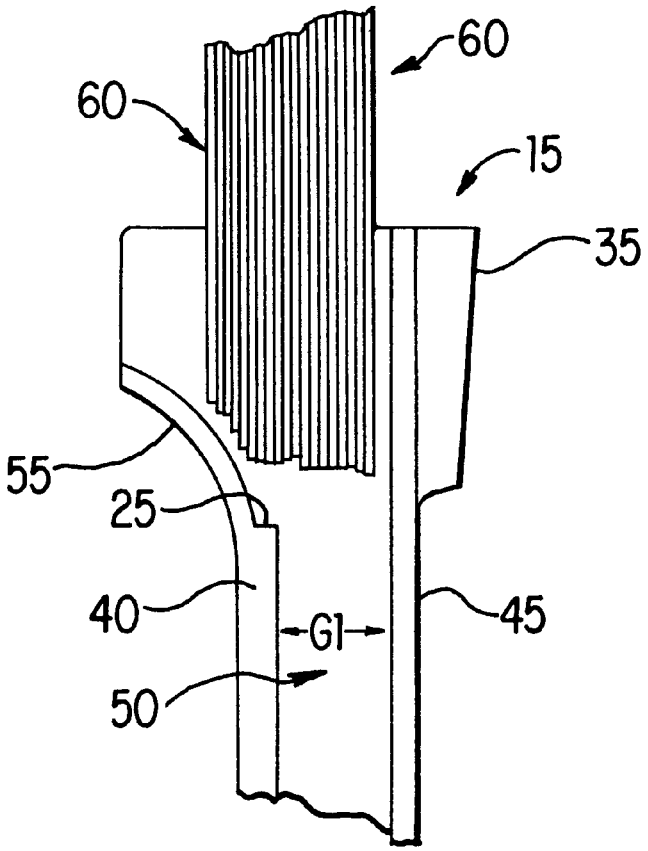
FIGS. 6–7 are end views taken along lines 5—5 of FIG. 4 and show sheet media therein.
Figure 7:
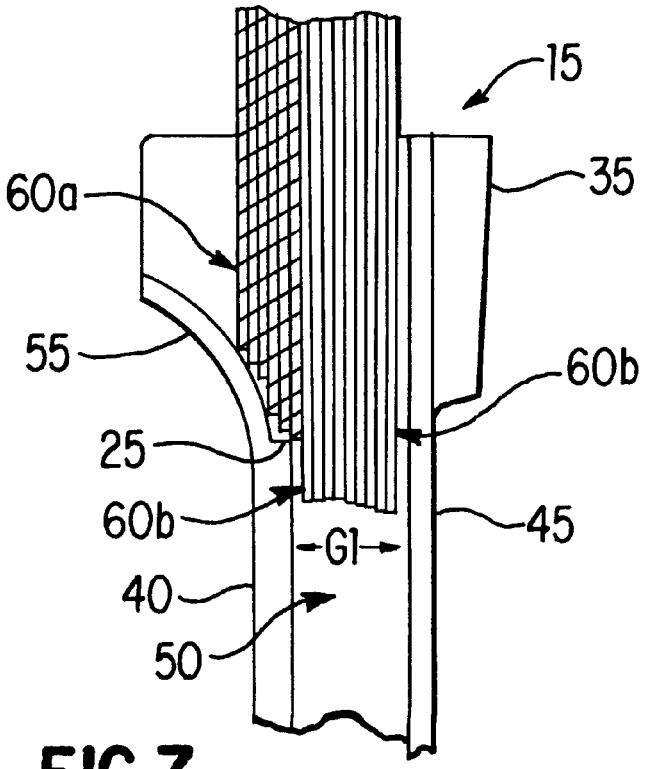

FIGS. 6 and 7 are similar to FIG. 5, but depict snap shots in time of a plurality of sheet media 60 being inserted into tray 15. FIG. 6 shows a plurality of sheet media 60 being inserted into enlarged opening G2 before the media has arrived at shelf 25. FIG. 7 shows how shelf 25 abruptly stops the excess sheet media 60*a* (shown in cross hatch) from entering into media passage area 50, but allows a "full" amount of media 60b to enter into area 50.

Finally, what has been described above are the preferred embodiments of an apparatus for preventing paper overfill in an input tray for an image processing device. While the present invention has been described by reference to specific embodiments, it will be apparent that other alternative embodiments and methods of implementation or modification may be employed without departing from the true spirit and scope of the invention.

What is claimed is:

1. A media input tray apparatus comprising:

(a) a support structure formed so as to receive sheet media therein and having an enlarged opening thereto; and, (b) a singular component abutment overfill control mechanism formed at a base of the enlarged opening for inhibiting excess media from passing further into the support structure.

2. The media input tray apparatus of claim 1 wherein the support structure is formed as part of a side adjuster for slidably supporting sheet media therein.

3. The media input tray apparatus of claim 1 wherein the enlarged opening is an angled or curved opening.

4. The media input tray apparatus of claim 1 wherein the support structure is disposed within an image forming device for enabling feeding of sheet media to the image forming device.

5. The media input tray apparatus of claim 1 wherein the support structure is oriented for receiving sheet media in an upright, on-end position.

6. The media input tray apparatus of claim 1 wherein the support structure is formed so as to receive a first amount of sheet media, the enlarged opening is formed so as to receive a second amount of sheet media larger than the first amount, and the excess media is defined by a difference between the first and second amounts.

7. The media input tray apparatus of claim 1 wherein the abutment overfill control mechanism is a shelf formed in connection with the enlarged opening.

8. A media receiving apparatus, comprising:

(a) at least first and second support structures disposed so as to form a media passage area therebetween and having a first gap;

(b) an angled or curved surface associated with at least one of the support structures, the angled or curved surface forming a widening gap with respect to the media passage area first gap; and, (c) an abutment fixedly disposed at an intersecting portion of the media passage area and the angled or curved surface for inhibiting media overfill of the media passage area relative to the first gap.

9. The media receiving apparatus of claim 8 wherein a second gap is formed between the support structures in connection with the abutment, and wherein the second gap is wider than the media passage area first gap.

10. The media receiving apparatus of claim 8 wherein the abutment is a ledge.

11. The media receiving apparatus of claim 10 wherein a second gap is formed between the support structures at the ledge, and wherein the second gap is wider than the media passage area first gap.

12. The media receiving apparatus of claim 10 wherein the angled or curved surface is formed in connection with the ledge such that media is abruptly halted at the ledge and thereby inhibited from entering into the media passage area if the media is placed too close to the angled or curved surface near the ledge upon attempted insertion of the media into the media passage area.

13. The media receiving apparatus of claim 8 wherein the support structures are formed as part of a side adjuster for slidably supporting sheet media within the receiving apparatus.

14. The media receiving apparatus of claim 8 wherein the apparatus is disposed within an image forming device for enabling feeding of media from the receiving apparatus to the image forming device.

15. The media receiving apparatus of claim 14 wherein the image forming device is a printer device and the media receiving apparatus is a media input tray mechanism.

16. The media receiving apparatus of claim 15 wherein the media input tray mechanism is oriented for receiving media in an upright, on-end position.

17. A media holding apparatus for an image forming device comprising:

a receiving area having a first gap for receiving a first quantity of sheet media therein; and, an enlarged opening area in connection with the receiving area, the enlarged opening area forming at least a second gap that is greater than the first gap, wherein the enlarged opening area and receiving area are connected in association with a fixed shelf such that any sheet media in excess of the first quantity that attempts passage into the receiving area from the opening area is abruptly restrained by the fixed shelf from passing therein.

18. The media holding apparatus of claim 17 wherein the enlarged opening area is formed from at least one angled or curved support wall.

19. The media holding apparatus of claim 17 wherein the enlarged opening area is formed as part of a side adjuster for slidably supporting sheet media within the holding apparatus.

20. The media holding apparatus of claim 17 wherein the image forming device is a printer device and the receiving area and enlarged opening area form a media input tray mechanism.

21. The media holding apparatus of claim 20 wherein the media input tray mechanism is oriented for receiving media in an upright, on-end position.

22. An image forming device comprising:

(a) a housing having a print engine; and, (b) an input tray mechanism adaptively interfitting with the housing, the input tray mechanism disposed so as to receive sheet media from an external source for subsequent feeding into the print engine, the input tray mechanism comprising:

(i) a first structure formed to cooperate with a second structure for receiving the sheet media therebetween in a first gap; and, (ii) a shelf fixedly disposed in connection with the first structure and near the first gap, whereby any of the sheet media that is in excess of an amount of sheet media capable of passing through the first gap is caught on the shelf and disallowed entry through the first gap as the sheet media is fed from the external source into the input tray mechanism.

23. The image forming device of claim 22 wherein the shelf forms a second gap between the first and second structures that is wider than the first gap.

24. The image forming device of claim 22 wherein the first and second structures are formed as part of a side adjuster for slidably supporting sheet media within the input tray mechanism.

25. The image forming device of claim 22 wherein the first structure includes an angled or curved wall in connection with the shelf.

26. The image forming device of claim 22 wherein the media input tray mechanism is oriented for receiving media in an upright, on-end position.

27. The image forming device of claim 22 wherein the print engine is, alternatively, an electrophotographic print engine or an ink jet print engine.

* * * * *